United States Patent [19]

Carreras Fontcuberta

[11] 4,370,939

[45] Feb. 1, 1983

[54] METHOD AND MECHANISM FOR INSERTING AN ELASTIC BAND IN SELECTED AREAS OF MATTRESS-WRAPPING BEDCLOTHES

[75] Inventor: Francisco Carreras Fontcuberta, Caldas de Montbuy, Spain

[73] Assignee: Bassetti S.p.A., Milan, Italy

[21] Appl. No.: 214,866

[22] Filed: Dec. 9, 1980

[30] Foreign Application Priority Data

Dec. 12, 1979 [ES] Spain ..... 486826
Sep. 10, 1980 [IT] Italy ..... 24573 A/80

[51] Int. Cl.[3] ..... D05B 21/00; D05B 97/00

[52] U.S. Cl. ..... 112/262.2; 112/121.26; 112/121.27; 112/121.15

[58] Field of Search ..... 112/262.2, 262.3, 262.1, 112/121.26, 121.27, 121.15, 121.12, 63, 3 R, 305

[56] References Cited

U.S. PATENT DOCUMENTS

| | | | |
|---|---|---|---|
| 2,907,289 | 10/1959 | Fernandez | 112/121.26 |
| 3,783,805 | 1/1974 | Guichard | 112/147 X |
| 4,036,156 | 7/1977 | Becker et al. | 112/305 X |
| 4,102,282 | 7/1978 | Hsiao et al. | 112/121.26 |
| 4,191,117 | 3/1980 | Della Torre | 112/121.15 X |
| 4,265,187 | 5/1981 | Torre | 112/121.26 |
| 4,290,376 | 9/1981 | Brusasca et al. | 112/121.26 |

*Primary Examiner*—H. Hampton Hunter
*Attorney, Agent, or Firm*—Morgan, Finnegan, Pine, Foley & Lee

[57] ABSTRACT

A method and a mechanical assembly are disclosed for mounting, on angular areas of a mattress-enveloping bed sheet or similar article, segments of elastic band to elasticize said angular areas. The method requires that the angular transversal seams which unite adjacent flaps of the sheet pairwise be detected by a thickness gauge so as to generate a signal going to a stitch counting assembly (SCA) wherein a preselected number of stitches corresponding to the angular area to be elasticized has been preselected. The sewing machine is thus started and begins to stitch the continuously fed fabric; meanwhile, a double fold is formed on the fabric edge by a specially provided shaping device. Immediately after, the elastic band feeding device enters action and introduce the elastic band in the fabric double fold for a time determined by the Stitch Counting Assembly (SCA) and the sewing machine sews the elastic band and the folded fabric together. As the preselected number of stitches has been applied, the elastic band feeding mechanism is withdrawn, the elastic band is locally twisted and a snipping blade housed in the presser foot of the sewing machine snips the elastic band the cycle is restarted and repeated until all the four corner areas of the bed-clothes article have been elasticized.

11 Claims, 15 Drawing Figures

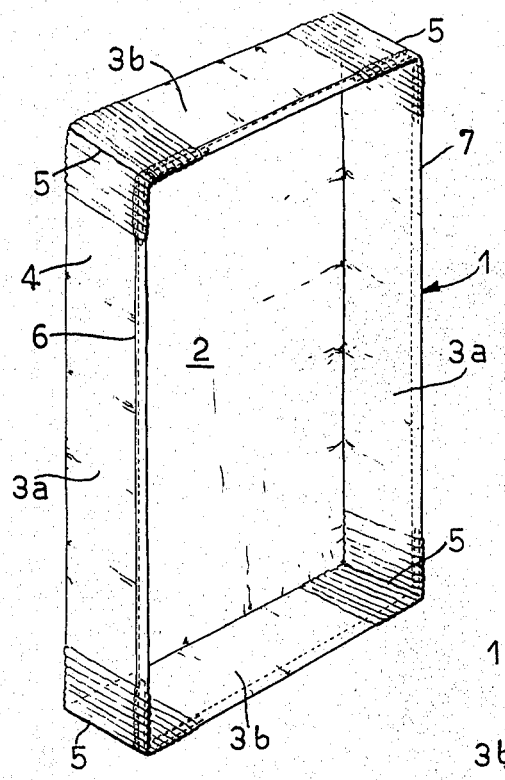
Fig.1
Fig.2
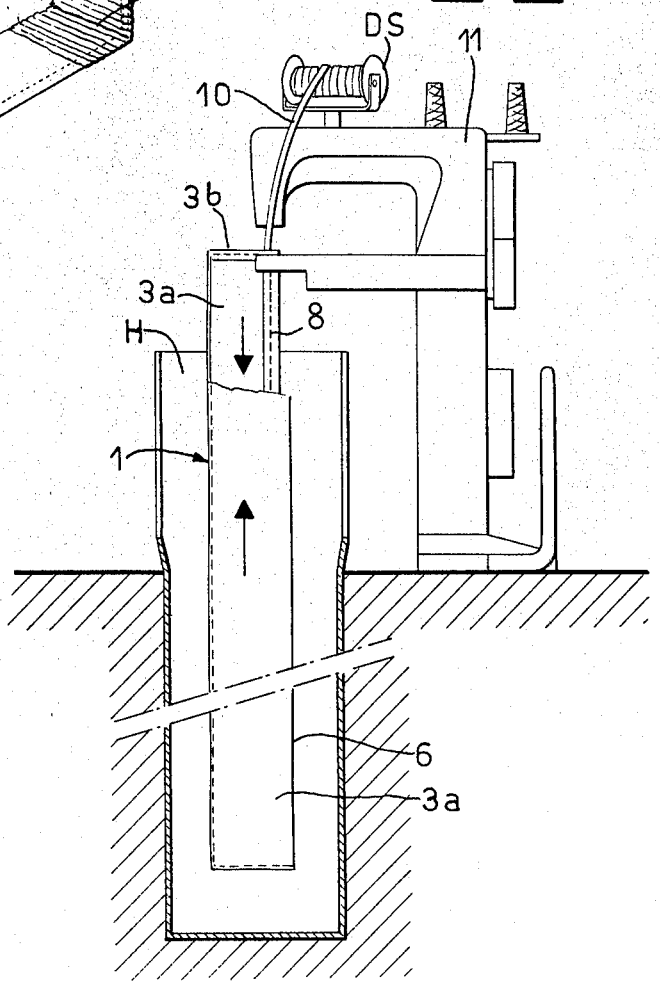

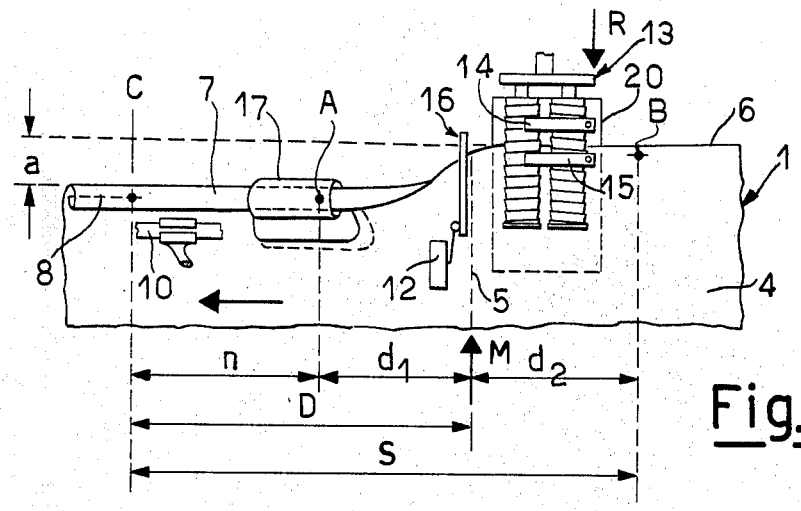
Fig.3
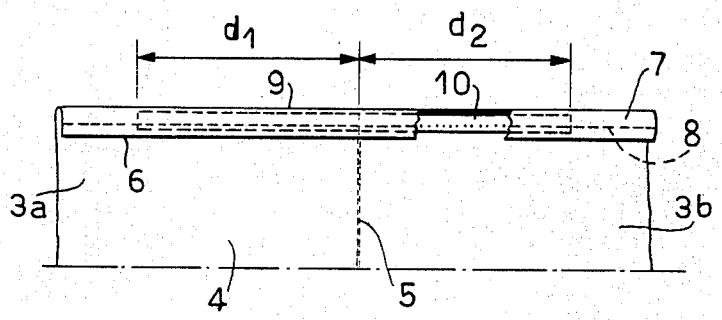
Fig.4
Fig.5
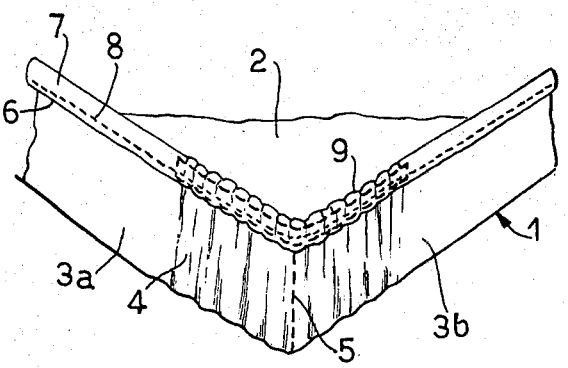
Fig.6
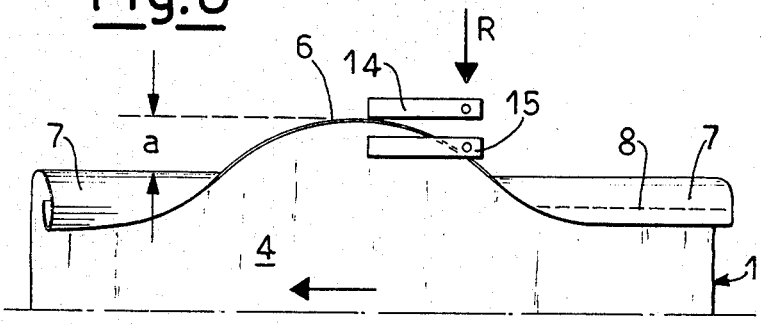

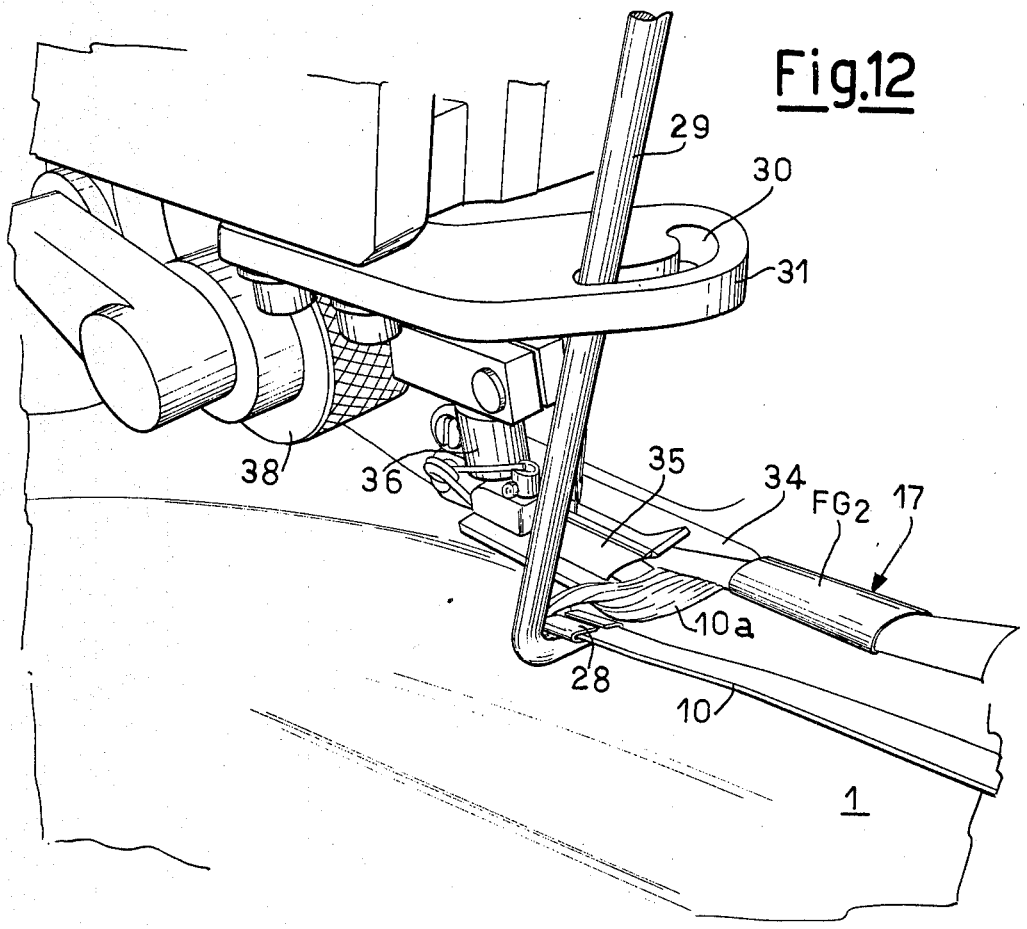
Fig.12
Fig.13
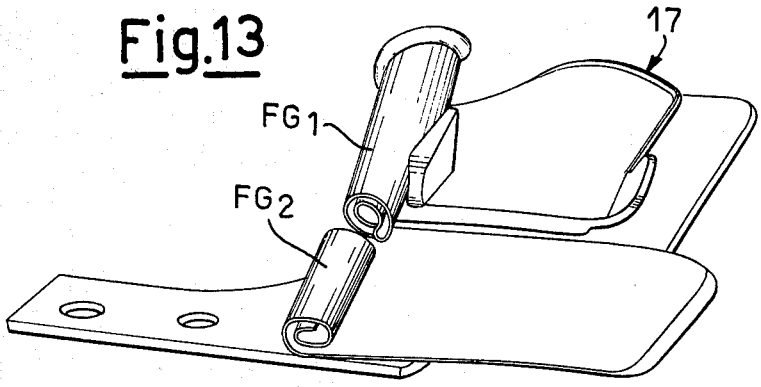

METHOD AND MECHANISM FOR INSERTING AN ELASTIC BAND IN SELECTED AREAS OF MATTRESS-WRAPPING BEDCLOTHES

This invention relates to a method and a mechanism for inserting an elastic band in selected areas of mattress-wrapping bedclothes.

It is known that, in recent times, the use has become more and more widespread of those kinds of bed sheets which completely envelope a mattress (generally of the spring type and the like) much in the manner of a hood or a close-fitting lining.

It is likewise known that such enveloping bed sheets are equipped in their angular areas, with segments of an elastic band in order to have the bed sheets closely and snugly adhering to the mattress on which they are slipped. Bed sheets of this kind have been envisaged in order to do away with the cumbersome sheet tucking operations and also fo facilitate the reverse operation, that which would entail considerable time saving both at home and for hotel use.

Lastly, it is also known that the operation of applying the elastic band to the angular areas or corners of the wrapping sheet is an operation which has been performed heretofore entirely by hand, that is, the elastic band had to be inserted into a fold of the sheet free edge and stitched thereon: the only operation which could be performed mechanically was to stitch the elastic band by means of a sewing machine, but the steps of folding the sheet edge, inserting the elastic band at the beginning of a corner area, snipping the elastic band on completion of an angular area stitching and withdrawing the elastic band out of the sewing path of the sewing machine prior to starting the cycle now outlined again as the next corner area of the bed sheet is reached, had compulsorily to be performed manually because no machine or mechanism existed heretofore, which was capable of performing such sequence of steps automatically and, above all, quite reliably.

As outlined above, the sequential process for applying an elastic band to angular areas of an enveloping bed sheet has been performed heretofore predominantly by hand: it will be appreciated, as the present disclosure proceeds, that a method and a mechanism have been envisaged for performing the sequence of steps outlined in the foregoing with a simple method and with simple mechanical and electrical means and with the aid of a properly adapted industrial sewing machine.

The basic principle underlying the method according to this invention is to take, as a reference member, the sewing seam which unites edgewise every adjoining pair of the four lateral flaps of the mattress-enveloping bed sheet. There are, of course, four of these flaps and thus four sewing seams: the elastic band is to be stitched just ahead of and past the sewing seam in each corner area. Once a sensing member feels such a seam, a stitch-counting operation is automatically started, the number of stitches being a function of the length of elastic band to be stitched or sewn to each respective angular area of the sheet, whereafter the sheet edge is properly folded inwards and can receive the elastic band in the pocket-like portion of the sheet edge thus provided, a signal being given to an elastic-band-inserting member for inserting the elastic band in said pocket and to the needle bar of the machine for starting to sew the elastic band to the inward folded sheet, and another signal for stopping the elastic bond insertion, for withdrawing the elastic band inserting member away of the sheet edge and snipping the elastic band length, the sheet being fed in the machine direction until the next angular seam is sensed and the cycle is started once again.

Stated another way, and more detailedly, the method according to the invention comprises the steps of automatically sensing with a certain time of advance the passage of the transversal edge seams of the sheet past a control point connected to the sewing machine and located ahead of the point of stitching, but at a predetermined distance therefrom. This passage originates a signal which starts the automatic feed of the elastic band (which must be kept taut) laterally into the folded sheet edge, so that the sewing operation is started concurrently with the feed of the elastic band and lasts for a determined number of stitches ahead of and past the transversal edge seam of the sheet, whereafter another signal is given, the elastic band is moved laterally, but in a sense contrary to the previous one, so as to be withdrawn from the sewing machine and consequently from the sewing line: at this stage, the elastic band, the previously free end of which is now firmly stitched to the sheet, undergoes a twisting motion and can be snipped by a snipping blade housed in the properly adapted presser foot of the sewing machine. It is noted, quite incidentally, that the snipping blade lies on a vertical plane and can be reciprocated: when in its inoperative position, the snipping blade is hidden within the presser foot wherefrom it protrudes to snip the elastic band as the blade is timely commanded to do so. The twisting motion aforementioned of the elastic band is intended to present the elastic band itself in the appropriate position for being snipped by the snipping blade at the proper instant of time, as will be described in greater detail hereinafter. Once the elastic band has been snipped, the conventional fabric feeding members of the sewing machine feed the sheet forward until the next transversal edge seam is sensed and the cycle just now described is performed once again.

A feature of the invention which deserves attention is the circumstance that the difference in width between the already sewn folded edge and the free edge of the peripheral border of the not yet sewn fabric, gives rise to a stopping signal which is indicative of the end of the automatic sequence of steps: only a small portion of folded edge to be sewn is left and this can be extremely quickly made by the operator prior to withdrawing the finished piece from the sewing machine.

Another characteristic of the invention which is extremely important, both from the point of view of a correct operation of the sewing machine and the satisfactory performance of the method, is that the article to be processed, that is, the bed sheet to which elastic band portions must be applied at preselected angular zones, must vertically and free hang from the machine: to this purpose, the machine is better mounted on a pedestal or a scaffold whereunder an appropriately deep vertical space (i.e. a pit, a shaft, a well or a hopper or anything of the kind) must compulsorily be provided: this feature is so important that it deserves to be insisted upon.

In order to put the method of this invention into constructive practice, the operation of an industrial sewing machine must be coordinated with the actuation of a guiding mechanism of the free peripheral edge of the sheet, with a mechanism for controlling the passage of the transversal edge seams, with a mechanism for inserting the tensioned elastic band, and with a mechanism for withdrawing the elastic band and snipping it out as the elastic band stitching operation has been completed: beneath the sewing machine, as suggested above, a sufficient vertical space must be provided so as to have the portions of the sheet which are not directly engaged by the sewing machine and/or by the guiding and controlling members thereof hanging freely vertically under the pull of their own weight.

The mechanism for initially guiding the free edge of the peripheral sheet flaps operates by having as a supporting base, an overhanging cylindrical supporting body, above which are cooperatively mounted two idle gears having a resilient ribbed rubber liner, the ribs or streaks being oriented in contrary directions, these gears being mounted on a rocker which is controlled by means adapted to sense the path of the peripheral free edge of the sheet. Either gear can be pressed against the cylindrical supporting body responsively to possible deviations of the sheet free edge relative to the expected correct trajectory thereof.

Such a guiding mechanism for the free edge of the sheet is commanded by means for sensing and detecting the path of the free edge of the sheet, said detecting and sensing means being preferably embodied by photoelectric cells and similar means: these latter detect any deviation of the sheet free peripheral edge so that the sheet can be brought back to its correct path line by acting upon either gear. If no free edge is sensed at all, a command is given to stop the sewing machine altogether, that which occurs in the case of an actual fault or, also, when the sequence of steps for applying the elastic band to all the four corner areas is over.

The transversal angular seams are sensed by a sort of thickness gauge mounted immediately downstream of the guiding mechanism described in the preceding paragraph hereof. Preferably, but not compulsorily, such a thickness gauge is comprised of a fixed portion and a movable portion hingedly mounted thereon. The clearance between the fixed and the movable portion corresponds to the average thickness of the fabric: as the lateral angular seam passes through the clearance aforesaid, the movable portion of the gauge is tilted forward (i.e. in the machine direction) and a microswitch is actuated, for example by a small rocker.

The thusly generated signal is sent to an electronic counting mechanism or circuit, so that the device for inserting the elastic band, or for withdrawing it from the sewing line as the case may be, is actuated.

The insertion of the elastic band in the folded down edge of the sheet is carried out by the agency of a sort of chock or fairlead mounted on the bottom end of an inserting rod: the latter is guided along an arcuate path the ends of which correspond to the insertion position of the elastic band and to the position of the elastic band out of the sewing line, respectively.

The longitudinal axis of the elastic band is always parallel to the sewing line, and the approaching or withdrawing motion of the inserting rod along the arcuate path defined by an arcuate slot formed in a guiding member secured to the machine frame are effected by a properly command linkage to be described in more detail hereinafter. It is to be remembered that the elastic band must constantly have a certain degree of tension or pull.

Once that the desired length of elastic band has been sewn to the folded down edge of the sheet in the angular area concerned, the elastic band is to be snipped: this operation is carried out by a snipping blade which is mounted in the properly adapted presser foot of the sewing machine, as already suggested in the foregoing. On completion of the snipping step, the inserting rod is brought to the opposite end of its arcuate path and the cyclical sequence of steps is resumed once again.

The principal object of this invention is to make it possible to perform, automatically and reliably, an operation which was predominantly a manual sequence of steps heretofore.

Another object of the invention is to provide an assembly of ancilliary mechanical members and circuitry means for adapting a common industrial sewing machine so as to enable said machine to perform all the operations which are required for applying, automatically and reliably, an elastic band to selected corner areas of a mattress-wrapping or enveloping bed sheet, virtually without any manual intervention of a machine attendant.

Other objects and advantages of the invention have already been outlined in the foregoing, and will be better appreciated as the particular disclosure of the method and the machine proceeds, in connection with a typical, preferred embodiment of the invention to be described in full detail hereinafter.

The accompanying drawings present a full disclosure of the best mode known to the present applicant for carrying the present invention into constructive practice, both in terms of method and mechanical and electric component parts to be attached to an industrial sewing machine of the type in common use in the textile manufacturing industry.

In the drawings:

FIG. 1 is an outline view of a stiff mattress to which the textile article concerned, that is, an enveloping bed sheet having elasticized corner areas, is applied.

FIG. 2 is a side elevational view, partly in cross-section, showing the overall layout of the machine and its principal component parts, as well as the textile article thereon.

FIG. 3 is a very diagrammatical showing of the operative principle of the method and the machine of this invention.

FIG. 4 is a diagrammatical view, developed on the plane of the sheet of the drawing, of a portion of the textile article in an angular or corner zone whereof an elastic band segment has been inserted.

FIG. 5 is a diagrammatical perspective view of that which has been shown in FIG. 4 above.

FIG. 6 is a diagrammatical showing of the free edge of the peripheral border of the bedclothes in the position immediately ahead of the point of sewing of the folded edge, and the point at which a width variation of the folded edge is experienced is also shown.

FIG. 12 is a fragmentary big close-up view showing the instant of time at which the elastic band is being withdrawn from the sewing position and a twist is being impressed thereto, whereafter the snipping blade snaps out of its guideway and snips said elastic band.

FIG. 13 is a detail perspective view of the fabric-guiding and folding member, which has been removed from the mechanism in order that its configuration may be better elucidated.

Figure 7:
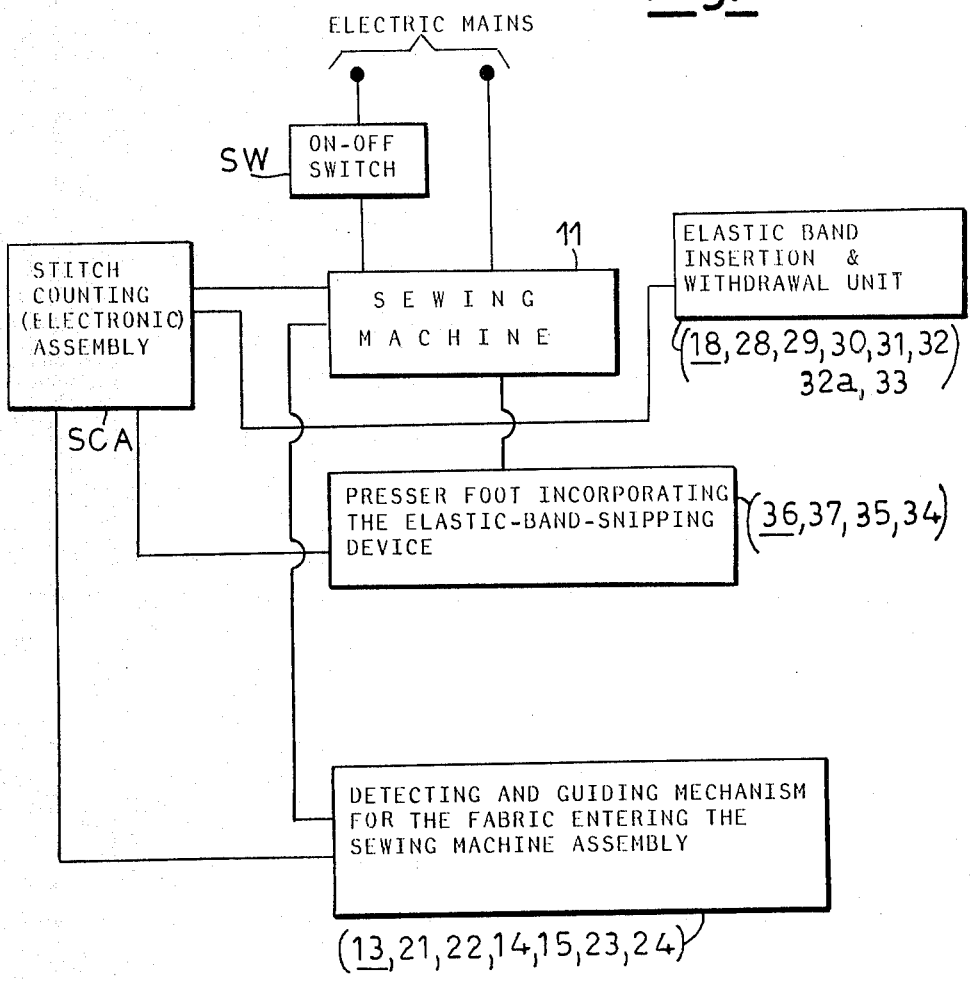
FIG. 7 is a block diagram which is illustrative of the principal steps of the method and the corresponding active component parts of the mechanical and the electric assemblies.

FIG. 1 of the accompanying drawings shows the textile article in question, that is, a kind of adjustable bed sheet which envelops, like a hood, a stiff mattress, for example a spring mattress.

The reference numeral 1 generally indicates the bed sheet.

The article has been imagined as having already been slipped onto a mattress and there can be distinguished the bed sheet proper, 2, which is the rear face as viewed in the drawing, the side flaps 3*a*, 3*a* and 3*b*, 3*b*, longer and shorter, respectively, which define together, when sewn with transversal seams 5, the side surface 4 of the sheet, which forms a closed loop. On the corner areas of the sheet and in the foreground, there can be seen the crimped elasticized portions (unreferenced). Of course, the elasticized corner areas will lie on the bottom rectangular contour, so that the bedclothes surface on which the sleeper's body rests is thoroughly smooth and creaseless.

FIG. 2 shows the textile article placed on the machine: it is essential, as already pointed out in the foregoing, that the plane defined by the ascending (or descending, as the case may be) borderline 6 of the article 1 is a vertical plane, at least with good approximation: if so, the feeding motion provided by the sewing machine 11 permits that the seamline 8 does not swerve from its expected path, and that all the operational steps may proceed smoothly without requiring any manual aid.

In order that this essential requirement may be fulfilled, a pit, or shaft, indicated at H, must be provided beneath the sewing machine, as shown in FIG. 2. The sewing machine 11 has been shown, for the moment, just in outline view with the dispensing spool DS for the elastic band.

The group of FIGURES from FIG. 3 to FIG. 6 inclusive are intended for giving a clear illustration of the method according to this invention.

The method according to the invention enables the free edge 6 of the lateral flap loop of the sheet to be shaped and folded to provide a fold 7 to be secured by stitches as applied by the sewing machine 11. In the interior of the sheath provided by folding the fabric at 7, an elastic band 10 can be inserted, to provide an elasticized corner zone 9.

The seamline 9 is performed by the conventional sewing machine 11 which must be mounted over a pit or a shaft, or on an adequately tall scaffold.

FIG. 3 best illustrates the basic principle of the method of this invention.

The fabric is folded such as at 7 on the free edge of the sheet 4 and the sewing operation is started at a point intermediate between two consecutive lateral transversal seams 5. The passage of the lateral transversal seams 5 is controlled at a checkpoint M ahead of the point of sewing C, the latter being spaced apart from M by a known (pre-established) number of stitches of the sewing machine. This pass through the checkpoint M originates a signal the effect of which is that, once a number of stitches, n, has been made, equal to the difference between the number of stitches D and the number of stitches $d_1$, corresponding to sewing of the initial portion of the elasticized zone 9, the feed of the elastic band 10 can be started. The number of stitches $d_1$, may be equal to, or different from, the number of stitches $d_2$ of the portion of the elasticized zone 9 which is past the lateral transversal seam 5 concerned. More detailedly, as a seam 5 goes past the checkpoint M, a microswitch 12, connected to an electronic circuit, commands, once the sewing machine has made a number of stitches $n=D-d_1$, and that the point a, at which the elastic band 10 begins to be inserted in the folded portion 7 of the fabric, has attained the position of sewing C, the start of the lateral introduction of the leading edge of the elastic band 10 into the folded area 7. The elastic band 10 is held within the folded area 7 until the preselected number of stitches $(d_1+d_2)$, ahead and past relative to the seam 5, has been applied. Thus, the point B of the fabric will have reached the sewing position C, at which the tensioned elastic band 10 is drawn away of the folded area 7 and is snipped, inasmuch as the preparation of the elasticized area 9 has been so completed.

As soon as the next seam 5 reaches the checkpoint M, the sequence of steps described above is repeated and the sewing of the non-elasticized edge of the sheet 1 is then completed.

It is preferred, but by no means compulsory, that the elasticized areas 9 be, each, symmetrically arranged relative to the seams 5; if this is the case, then $d_1$ equals $d_2$, this situation being best seen in FIG. 5.

The abrupt width variation a (FIGS. 3 and 6) between the already sewn folded area 7 and the free edge 6 of the side flaps 4 is exploited for delivering a signal at a position R (FIG. 3) which indicates that the entire zone of 4 to be elasticized has passed past thereof, the result of the signal being the stoppage of the sewing machine 11. The point R is at a distance from the sewing position C which corresponds to a number of stitches S to be made by an operator who actuates the sewing machine independently as the article is withdrawn from the machine, so that the sewing of the starting and the finishing ends of the folded area 7 can be completed.

The stopping point is materially embodied by a guiding mechanism 13 of the free edge 6 and a photoelectric cell 15, or an equivalent means, is provided therefor.

The detection of the passage of the seam 5 past the control point M is made by the agency of a thickness gauge 16 operatively connected with a microswitch 12 or any equivalent arrangement.

The automatic formation of the folded areas 7 by abating the edge 6 of the fabric is performed by a specially provided shaping horn 17, which is comprised of two shaping and fabric guiding portions $FG_1$ and $FG_2$, best shown in FIG. 13 and elsewhere in the accompanying drawings.

The block diagram of FIG. 7 is intended to show, in a summarized bird's-eye view, the various functional interconnections between the various functional units of the entire assembly: it is not a wiring diagram proper inasmuch as the circuitry can be designed in any appropriate manner by anyone skilled in the art of electric and electronic circuitry design.

FIGS. 8, 9, 10, 11 and 12 of the accompanying drawings show in greater detail the component parts and the principal operative positions of the mechanism which performs the method according to the present invention.

The operation of inserting the elastic band 10 in the desired corner zones of the bed sheet 1 is carried out by functionally associating the forward feed of the textile article by the appropriate mechanisms of the sewing machine 11 with the guiding assembly 13 for the sheet edge 6, the thickness gauge 16, the insertion unit 18 for the elastic band 10 and a cutting unit, generally indicated at 19. A fabric-leading apron LA is provided before the assembly 13, immediately beneath same.

The textile article 1 is placed, at the outset, on a cylindrical supporting member 20, secured overhangingly to a fixed part of the machine 11: above the supporting member 20, there are mounted, on a rocker 23, the idle gears 21 and 22. These latter have striped rubber liners of soft rubber to have a good grip on the fabric. A pneumatic ram 24 actuates the rocker 23 and is controlled by a detector of the path trodden by the edge 6 of the fabric: such detector, in the example shown, is the photoelectric cell 14. The photoelectric cell signal acts in such a way as to press either of the two rubber-lined gears 21 (or 22) against the cylindrical core 20, the edge 6 of the fabric being inserted therebetween.

The photoelectric cell 14 checks the swerve of the edge 6 out of the expected path, whereas the photoelectric cell 15, a safety photoelectric cell in fact, detects the separation or even the total absence of the fabric edge 6, and stops the machine 11.

An independent general ON-OFF switch SW is also provided.

The detection of the lateral angular seams 5, which are, as indicated above, the governing members of the entire operability of the machine, is made by the agency of the thickness gauge 25. The latter is composed by a first arcuate portion 26 and a second supporting portion 27, hingably connected to one another. When the thickness increase due to the pass of the seam 5 through the gauge is detected, the movable portion 26 is swung forward, i.e. in the fabric-feed direction, and urges a small rocker-and-follower unit 12*a* of the microswitch 12, so that a signal is generated, which will command, at the proper time and as a function of the number of stitches counted by the Stitch Counting Assembly SCA (FIGS. 7 and 14–14A), the energization and de-energization of the unit 18 which is intended to insert the elastic band 10 or to withdraw it. Thus, also the points A and B of start and end of each angular elasticized zone 9, are correctly and univocally defined.

The unit 18 for inserting the elastic band 10 in the folded portion 7 of the flaps 4 is comprised of a chock or fairlead 28 which is mounted endwise on an inserting rod 29. The latter is guided within an arcuate slot 30, formed through a plate 31 secured in a cantilever way or so, to the frame of the sewing machine 11. The shape and the dimensions of the arcuate slot 30 are to be so selected as to correspond to the amplitude of the trajectory of the fairlead 28 and thus of the elastic band 10 pinched thereby towards and away of the stitching area of the machine 11.

Figure 8:
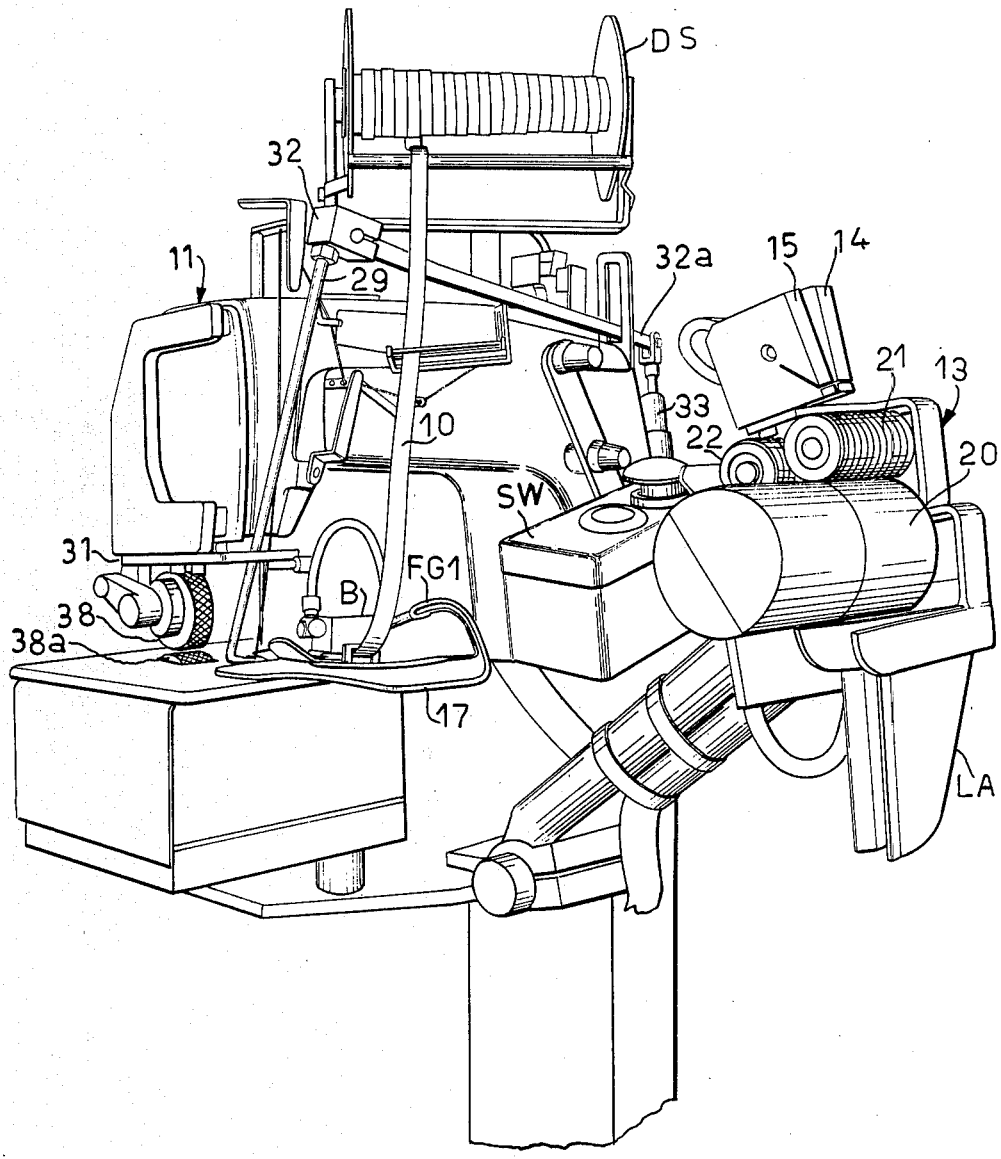
FIG. 8 is a perspective view of the principal active component parts of the mechanism and shows the general arrangement thereof.
Figure 9:
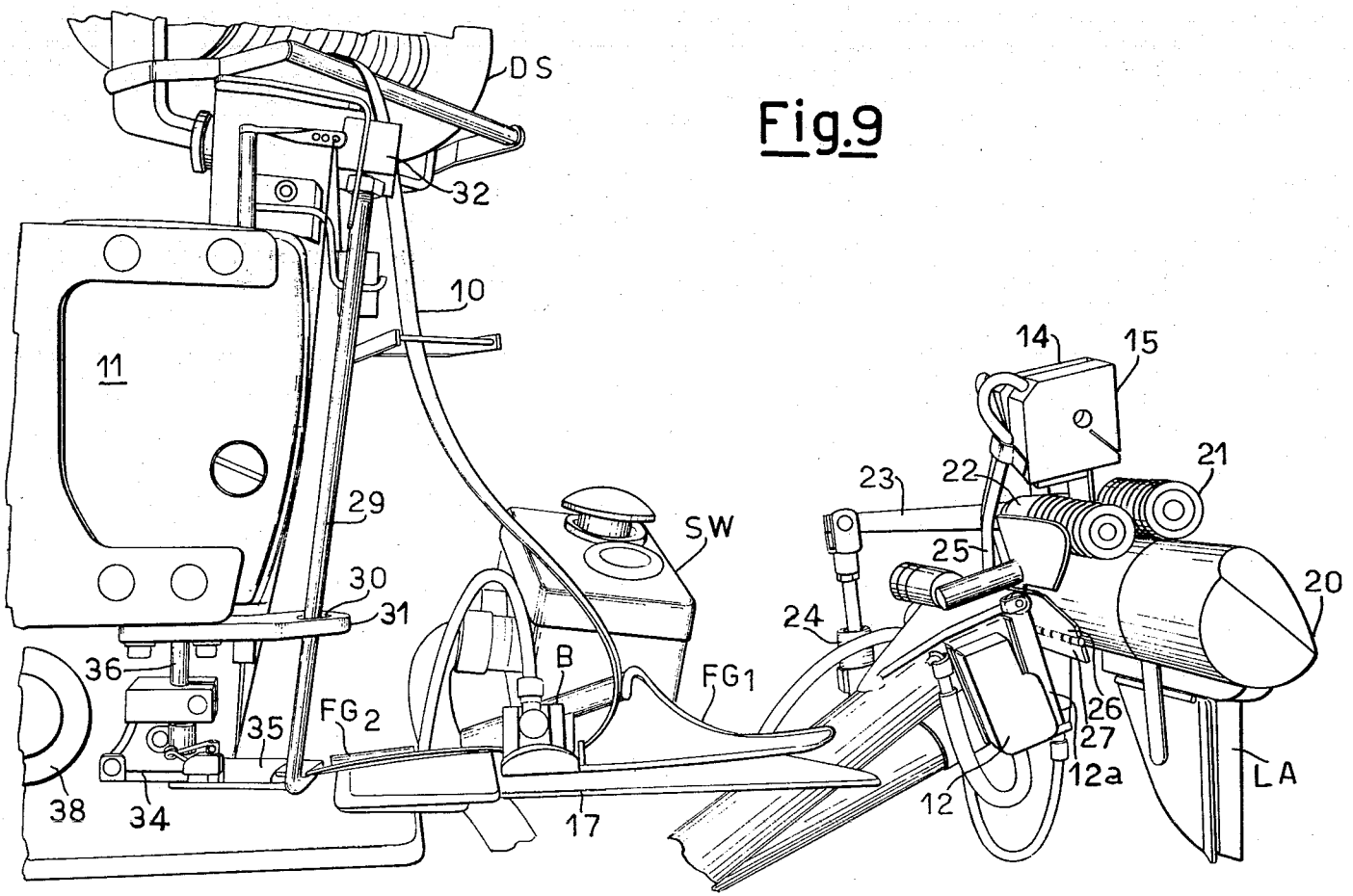
FIG. 9 is a perspective close-up view of the principal active component parts of the mechanism.

The inserting rod 29 is controlled by a rocking assembly 32, 32*a* moved by a pneumatic ram 33, under the overall control of the Stitch Counting Assembly SCA (FIG. 7 and FIG. 8).

The operation of the snipping unit 19 for cutting the elastic band 10 as the desired segment thereof has been secured by stitching to the intended angular zone of the bed sheet 1 is as follows.

The usual presser foot, which is present in all the conventional sewing machines, should be adapted so as to house a snipping blade 34 which lies and is reciprocated on a vertical plane within a guideway 35 formed in the adapted pressure foot 36: this is virtually the only modification which must be introduced in the sewing machine proper 11 to carry out the method of this invention. It will be appreciated that all the other functional units and mechanical members which have been described up to now herein and to be described hereinafter are, in actual practice, attachments external to the sewing machine proper. It is hardly necessary to recall that the pressure foot 36 is a readily interchangeable part so that, if so required, it can be removed and replaced by a conventional pressure foot and the machine used for operations other than those specifically contemplated herein.

Figure 10:
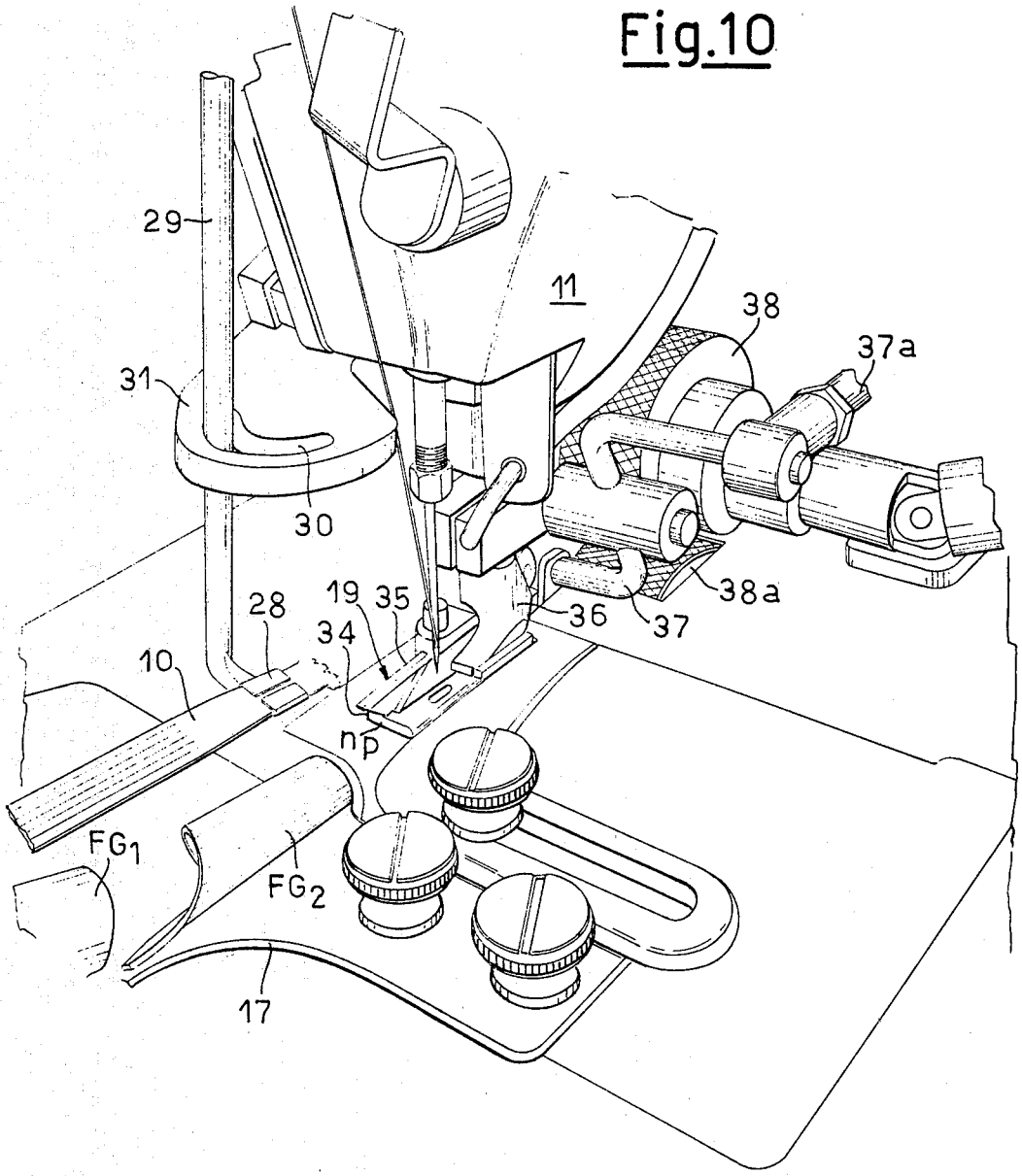
FIG. 10 is a big close-up view showing the respective positions of the several active component parts of the mechanism with the inserting rod and the elastic band carried thereby in its inactive position.
Figure 11:
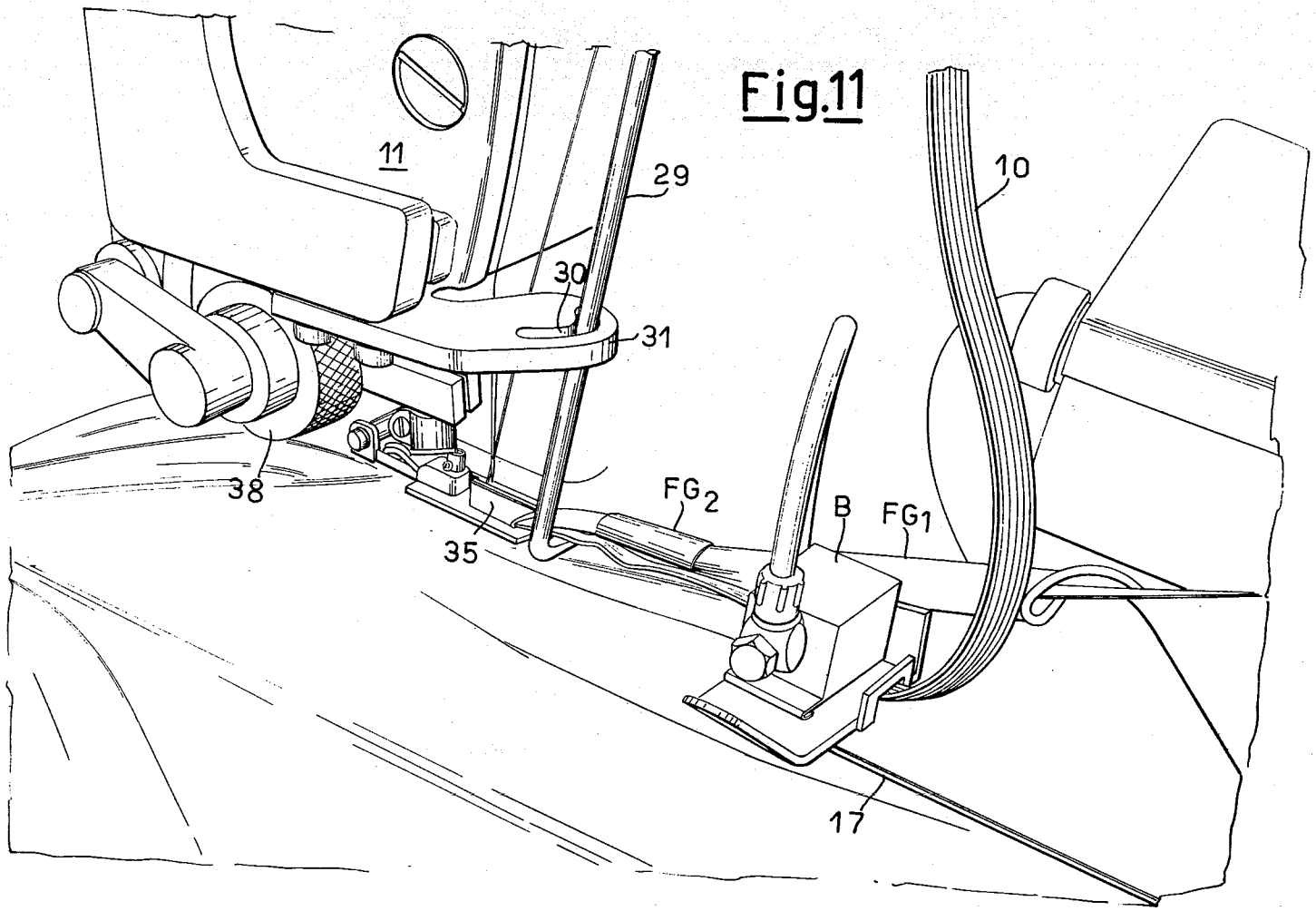
FIG. 11 is a big close-up view, akin to that of FIG. 10 but as viewed from the opposite side, and shows the instant at which the elastic band is slipped under the folded edge of the bed sheet, a portion of the latter being also shown.

Special attention is now invited to FIGS. 10, 11 and 12 of the accompanying drawings.

FIG. 10 shows the position of the principal component parts of interest for the elastic band insertion and there can be seen the reciprocable snipping blade 34 mounted in its guideway 35 within the presser foot 36: the blade is now in its inactive position.

All these members make up the snipping unit 19.

The reciprocal motion of the snipping blade is carried out by a common crank mechanism 37, best seen in the foreground of FIG. 10, and the mechanism 37 is actuated by the pneumatic ram 37*a* to be seen in the background. Of course, the actuation of the snipping blade 34 is synchronized as a function of the number of stitches as counted by the Stitch Counting Unit SCA.

FIG. 10 also shows, though unreferenced, the usual needle-bar, the needle, the needle plate n, p, and a bight of sewing thread, and the fabric feeding knurled wheels 38 and 38*a* which cause the textile article 1 to be fed forward in a manner which is conventional as itself. Also visible in FIG. 10 are the fabric folding flares $FG_1$ and $FG_2$ which make up the folding unit 17 best seen in FIG. 13: this unit serves to impress the doubling fold to the fabric and to form in this way a sort of a sheath intended to envelop the elastic band 10. The band is quite conventional and is a textile band having fine India rubber strings woven therein, or strings of another elastomeric material.

FIG. 11 is a picture of the instant of time at which the inserting rod 29 is in the innermost position in the arcuate slot 30: by comparison with the view of FIG. 10, it will be seen that, in the former drawing, the rod 29 was in the outermost position within 30.

FIG. 11 clearly shows the folded (doubled) fabric edge and the other component parts of the mechanism as shown and described in connection with the comment to the previous FIG. 10.

FIG. 12 depicts now the instant of time at which the inserting rod 29 is restored to the position it had in FIG. 10: the difference is that, in FIG. 10, the elastic band 10 had already been snipped and its leading edge, slightly frayed, could be seen in the previous FIGURE, whereas in the present FIG. 12 the elastic band 10 is still attached to its portion which has been stitched to the sheet fabric 1. On remembering that the elastic band borne by the rod 29 and upstream relative to the chock (fairlead) 28 is in any case (FIGS. 10, 11, 12) parallel to the sewing line, or machine direction line, or so with fair approximation, and that the snipping blade 34 is vertical and parallel to the machine direction also, it will be appreciated that, as the rod 29 is shifted from the innermost end position in the slot 30 to the outermost position therein, the elastic band 10, being secured to the fabric for having been sewn thereto, receives a twist which can be seen at 10*a* in FIG. 12: thus, it is presented in such a position as to be conveniently snipped by the snipping blade 34 (also visible in the drawing) as the latter snaps out of its seat in the presser foot 36. It is to be recalled, once again, that the elastic band 10 must be pretensioned: for this purpose a simple presser brake B (best seen in the foreground in FIG. 11) can be provided, or any other equivalent device. The braking unit B for the elastic band 10 is pneumatically actuated in the case in point, but other types of actuation and command are always possible. What counts is that also the ON and the OFF positions of the braking mechanism B be properly synchronized and attuned with the other machine functions.

Figures 14, 14A:
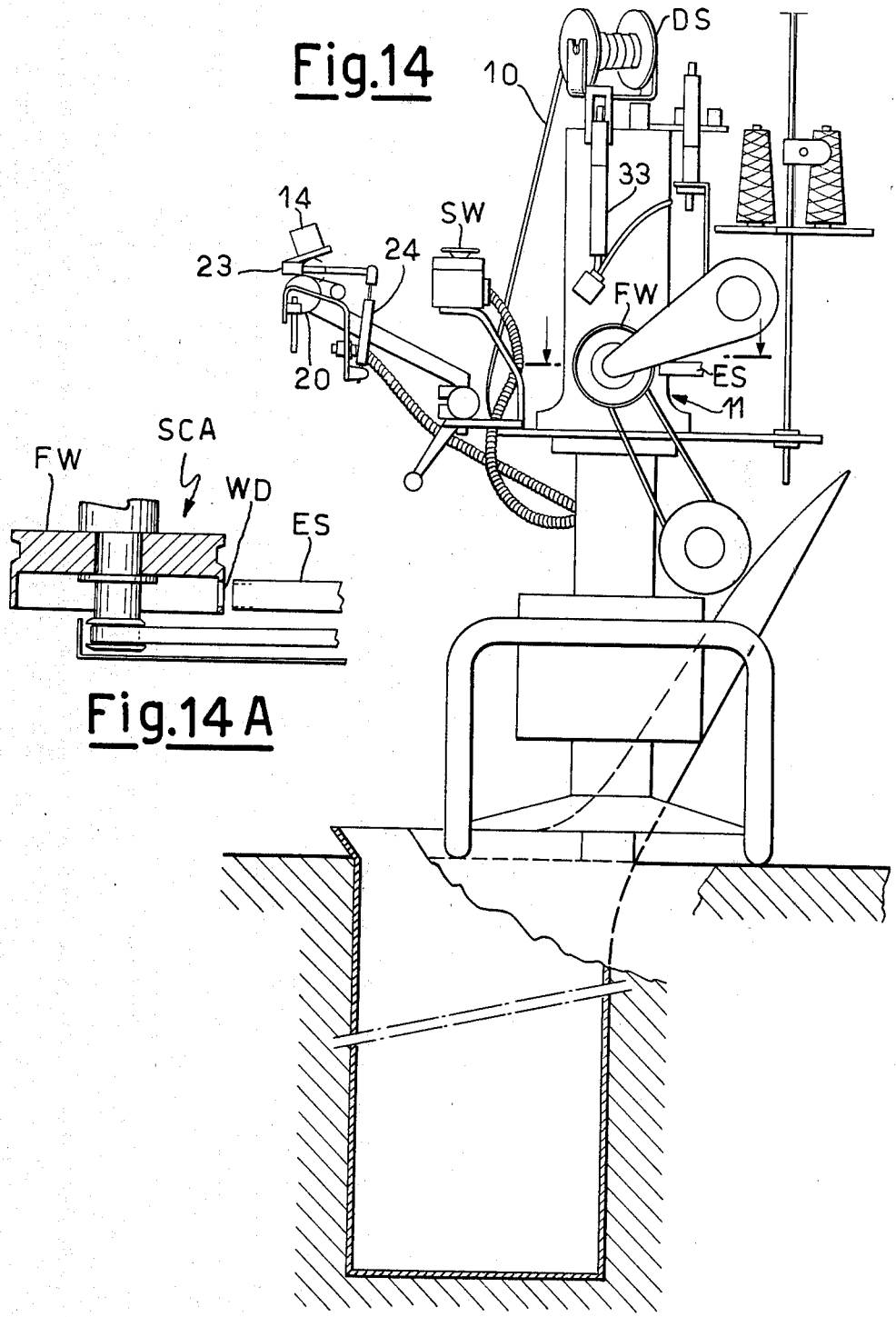
FIG. 14 is a side view of the machine to illustrate other component parts not fully shown in the other FIGURES.
FIG. 14*a* is a detail view for illustrating the stitch-counting device in some detail.

Lastly, FIGS. 14 and 14A show the details of the Stitch Counting Assembly SCA. The flywheel FW of the sewing machine 11 has a window formed in its peripheral surface and an electronic sensor ES (for example one of magnetic field sensitive type) counts the passes of the window WD before the sensor ES, that is to say, the revolutions of the machine mainshaft and thus the complete reciprocations of the needle bar and so eventually the stitches.

All this requires no special skill and can readily be provided for by any skilled artisan.

It is not certainly redundant to say that the method of the invention lends itself very well to being performed by a control microprocessor which can easily be programmed by any skilled electronic expert: the mechanisms which are necessary for performing the method of the invention have already been described in detail and their operation explained and it will be appreciated, inter alia, that they are not at all intricate or expensive so that to equip a factory with them is no problem absolutely.

While the invention has been shown and described in connection with a preferred embodiment thereof, be it understood that modification and changes can be introduced therein without departing from the scope thereof.

I claim:

1. A method for inserting an elastic band in selected angular areas of a mattress-wrapping bed sheet, comprising the steps of:

1. sensing the sewing seam uniting edgewise one of the four lateral flaps of said mattress-enveloping bed sheet;
2. signalling the sensing of such sewing seam to a stitch-counting assembly of a sewing machine in which a preselected number of stitches has been preset, corresponding to the length of said angular areas to be elasticized;
3. detecting the correct position of the bed sheet relative to the selected sewing line and guiding the bed sheet therealong causing the bed sheet portion not directly engaged by the folding and sewing operation vertically and freely to hang down;
4. folding the sheet edge at a position ahead of the sewing zone to form a sheath intended to house an elastic band therewithin;
5. introducing the leading edge of a pretensioned elastic band into the sheath formed by the doubled edge of said bed sheet and starting the operation of the sewing needle of the machine to sew said elastic band and said doubled bed sheet edge together;
6. continuing the feed of elastic band and the sewing thereof along a sewing path length corresponding to said predetermined number of stitches;
7. moving said elastic band away of said sewing line and impressing a twist to the unsewn portion thereof;
8. snipping said elastic band twisted portion perpendicularly;
9. continuing the edge-folding operation and the sewing operation without the elastic band being present until the next following lateral-flap sewing seam is sensed;
10. resuming all the sequence of steps from 1 to 9 hereof until all the four angular areas of said mattress-enveloping sheet have been elasticized by respective segments of said elastic band;
11. finishing the sewing of the remaining non-elasticized zone of said bed sheet doubled edge, and
12. removing the finished textile article from the sewing area.

2. A sewing machine, comprising, in combination:

(a) an industrial sewing machine having a needle, a needle-bar, a needle-bar reciprocating mechanism, a needle plate, a shuttle, a presser foot and a fabric-feeding mechanism;

(b) a fixed member for supporting the fabric to be fitted with an elastic band and for guiding it towards the sewing area of said sewing machine;

(c) a free vertical space beneath said fabric-supporting fixed member to have the portion of the fabric which is not engaged by the sewing machine freely and vertically depending;

(d) means for pressing the fabric entering the device against said fixed supporting member under the control of at least one device capable of sensing the position of the fabric edge;

(e) a thickness gauge for sensing the thickness of the transversal angular seams of said bed sheet;

(f) a fabric-edge-shaping and doubling device placed immediately downstream of said fabric-pressing means and said position-sensing device(s) for folding down the edge of said bed sheet fabric;

(g) an elastic band dispensing spool placed above said sewing machine;

(h) a mechanism for leading the elastic band towards the folded down fabric edge, for maintaining said elastic band in the space provided by said folded down fabric edge until said edge and said elastic band are sewn together, and for withdrawing said elastic band away of the sewing area of said sewing machine and of said folded fabric edge while concurrently impressing a twist to the unsewn portion of said elastic band;

(i) a braking device for tensioning said elastic band;

(j) a snipping mechanism essentially consisting of a snipping blade reciprocable on a vertical plane and housed in a specially provided space of the presser foot of said sewing machine;

(k) a stitch-counting assembly associated to a rotatable component part of said sewing-machine, and (l) means actuable by said thickness gauge for starting the operation of the sewing machine and having it continued for a time as determined by said stitch-counting mechanism.

3. Device as claimed in claim 2, wherein said fixed member for supporting the fabric consists of a generally cylindrical body on which the fabric entering the device is guided towards the sewing area of the sewing machine.

4. Device as claimed in claim 2, wherein said free vertical space beneath the fixed supporting member is a pit having a depth substantially in excess of the peripheral length of the bed sheet.

5. A device as claimed in claim 2, wherein the means for pressing the fabric entering the device consist of two rubber-lined gears mounted on a rocking arm for alternatively urging either gear against said fabric and of an actuating mechanism for moving said rocker arm.

6. Device as claimed in claim 5, wherein said fabric-pressing means have photoelectric detection means associated therewith to sense the presence and the position of said fabric edge relative to the sewing line.

7. Device as claimed in claim 2, wherein said thickness gauge consists of a fixed portion and a movable portion hingedly connected together, said movable portion being active upon switching means to deliver an electric signal as one of said transversal-edge angular seams of said fabric is sensed by said movable portion being tilted towards the sewing area of said sewing machine.

8. Device as claimed in claim 2, wherein said fabric-edge shaping and doubling device consists of two spaced apart horn-shaped members, the horn-shaped member placed upstream being broader than the horn-shaped member placed downstream in order progressively to shape and fold down the fabric edge prior to the introduction of the elastic band therewithin.

9. Device as claimed in claim 2, wherein said elastic band feeding and withdrawing mechanism consists of a rod pivoted to a linkage secured to the sewing machine frame, said rod being guided within an arcuate slot formed through a planar guideplate overhangingly secured to said machine frame, the free end of said rod being terminated by an elastic-band-retaining fairlead, and driving means for moving said rod from either end to the other end of said arcuate slot and vice versa so as to impress to said rod movements towards and away of the sewing line, respectively.

10. Device as claimed in claim 2, wherein said snipping mechanism for the elastic band consists of a snipping blade housed vertically for reciprocation within a guideway formed in a space formed in the presser foot of said sewing machine, and a leverage for impressing abrupt reciprocation motions to said blade, said leverage being a crank mechanism secured to the frame of said sewing machine.

11. Device as claimed in claim 2, wherein the means actuable by the thickness gauge for starting the operation of the sewing machine is a microswitch the armature of which is driven by the movable portion of said thickness gauge.

* * * * *